US005222490A

United States Patent [19]

Pomerantz et al.

[11] Patent Number: 5,222,490

[45] Date of Patent: Jun. 29, 1993

[54] BREATHING REGULATOR HAVING AIR INJECTOR FEATURE

[75] Inventors: Mitchell P. Pomerantz, Highland Park; Ramon A. Fundora, Chicago, both of Ill.

[73] Assignee: Dacor Corporation, Northfield, Ill.

[21] Appl. No.: 914,789

[22] Filed: Jul. 16, 1992

Related U.S. Application Data

[63] Continuation-in-part of Ser. No. 766,054, Sep. 26, 1991, abandoned.

[51] Int. Cl.[5] ..... A62B 7/04

[52] U.S. Cl. ..... 128/204.26; 128/205.11; 128/205.24; 137/908; 137/494

[58] Field of Search ..... 128/201.28, 204.26, 128/205.11, 205.24; 137/540, 494, 908; 251/310

[56] References Cited

U.S. PATENT DOCUMENTS

| | | |
|---|---|---|
| 2,728,340 | 12/1955 | Meidenbauer, Jr. . |
| 3,783,891 | 1/1974 | Christianson . |
| 4,022,202 | 5/1977 | Price . |
| 4,041,977 | 8/1977 | Matsuno . |
| 4,041,978 | 8/1977 | Leemann . |
| 4,140,112 | 2/1979 | Kobzan . |
| 4,147,176 | 4/1979 | Christianson . |
| 4,214,580 | 7/1980 | Pedersen . |
| 4,503,852 | 3/1985 | Christianson . |
| 4,616,645 | 10/1986 | Pedersen et al. . |
| 4,796,618 | 1/1989 | Garraffa . |
| 4,798,202 | 1/1989 | Chambonnet . |
| 4,862,884 | 9/1989 | Christianson . |
| 5,035,238 | 7/1991 | Christianson . |
| 5,042,473 | 8/1991 | Lewis . |

*Primary Examiner*—William H. Grieb
*Assistant Examiner*—Sebastiano Passaniti
*Attorney, Agent, or Firm*—Welsh & Katz

[57] ABSTRACT

A breathing system regulator for a demand breathing system has adjusting apparatus for adjusting the demand required to open the air inlet valve to permit the user to increase or decrease the tension on the biasing spring urging the valve closed, and to decrease or increase the cushioning effect of a stream of air urging the valve closed. Adjusting apparatus is provided in which an air injector device is adjustably positioned to direct a flow of air between positions for adjusting the pressure at the inlet valve side of the regulator diaphragm to control the amount of breathing effort required of the user to open the air inlet valve.

18 Claims, 3 Drawing Sheets

BREATHING REGULATOR HAVING AIR INJECTOR FEATURE

RELATED APPLICATION

This application is a continuation-in-part of commonly assigned U.S. Ser. No. 07/766,054 filed Sep. 26, 1991 for BREATHING REGULATOR HAVING AIR INJECTOR FEATURE now abandoned.

BACKGROUND OF THE INVENTION

1. Field of the Invention

The present invention relates generally to breathing regulators for use with demand breathing systems in diving, such as scuba diving, and more particularly to regulators for such systems in which the quantity of air or other gas or gaseous mixtures supplied to the user is determined by the breathing demands of the user and is adjustable by the user during such use.

2. Prior Art

Demand breathing systems used for diving, particularly scuba diving, typically employ a tank of breathable air or other breathable gaseous mixture (hereinafter referred to as "air" for the sake of brevity), a valve at the tank reducing the pressure of the mixture to approximately 140 psi as a first stage of regulating the pressure, a regulator to further reduce and control the pressure of the air in accordance with the breathing demand of the user as a second stage regulation, and a mouthpiece pneumatically coupled to the regulator through which the user breathes and receives air from the system. Typically the regulator employs a flexible diaphragm which senses the breathing demand of the user, and upon inhalation, the diaphragm is deflected in a first direction, opening a valve within the regulator to admit air from the tank valve to the mouthpiece and to the user. Upon exhalation, the exhaled air passing through the mouthpiece and into the regulator increases the pressure, deflecting the diaphragm in a second or opposite direction causing the valve within the regulator to close, and due to the increased pressure in the regulator, a portion of the air within the regulator is exhausted, equalizing the pressure on the diaphragm. Air can be exhausted by deflection of the diaphragm or a portion thereof away from its seat and exhausted between the diaphragm and its seat or through a separate exhaust valve.

Improvements on the typical demand breathing systems have been made to reduce or control the extent of the breathing demand required to open or crack the valve within the regulator and exhaust exhaled air, particularly where the conditions, such as depth of diving, changes the demand required as compared to ambient or surface or near surface conditions.

Such improvements have included the provision of a conical platform for the diaphragm to provide a varying effective area and permit the diaphragm to function as an exhaust valve, as in U.S. Pat. No. 4,147,176 to Christianson. U.S. Pat. No. 4,147,176 also provides an aspirator opening downstream of the valve in the regulator to direct the airflow, and in one embodiment provides for adjustment of the direction of the airflow by the user. However, in the arrangement disclosed in the patent, the user may adjust the direction of the airflow to obtain a favorable breathing demand during one portion of the breathing cycle, but in so doing may cause misadjustment, uncomfortable or even difficult operation during another portion of the breathing cycle.

Another attempted improvement is disclosed in U.S. Pat. No. 4,796,618 to Garraffa, in which an adjustable flow vane is provided in the flow of air toward the mouthpiece to deflect a portion of that flow toward or away from the mouthpiece. In the arrangement disclosed in U.S. Pat. No. 4,796,618, the vane can be adjusted between extremes by the user to substantially defeat the assisting effect of the directing of the airflow on the breathing demand required of the user. Such defeat of the assisting effect can cause uncomfortable breathing demand or difficulty in breathing by the user. A disadvantage of this arrangement is that the deflecting of a portion of the main air stream away from the mouthpiece may impede the delivery of air to the user.

Therefore, there is a need for adjusting apparatus for demand breathing systems which provides for selectively assisting the breathing demand of the user during substantially all of the breathing cycle, and which provides for selective adjustment by the user of the demand requirement and smooth operation of the system during its use.

SUMMARY OF THE INVENTION

An object of the present invention is the provision of adjusting apparatus for a demand breathing system which provides for adjustment over a limited range of the demand requirement of the user, which is readily adjustable by the user during use of the system and which reduces the possibility of extreme adjustment which may cause unbalance or difficulty to the user in using the system.

This and other objectives of the invention are achieved by providing adjusting apparatus in connection with a second stage regulator whereby the amount of force required to open or crack the valve and a portion of flow of air from the valve may be selectively adjusted to assist the user in comfortable breathing required by that user under conditions then present.

More particularly, a user demand breathing system typically includes an air supply, an air supply valve controlling the amount of air supplied from the air supply to the system, a mouthpiece and a regulator device pneumatically coupled between the air supply valve and the mouthpiece. The regulator device most often has a diaphragm mounted within the regulator device so as to be movable in response to the breathing demand of a user breathing through the mouthpiece, a lever with a portion normally abutting a portion of the diaphragm, and thus being controlled by the movement of the diaphragm, and an air inlet valve within the regulator. The air inlet valve has a housing which encloses a valve seat, a valve stem movable within the housing with respect to the valve seat, and adjustable spring biasing means for biasing the valve stem against the valve seat. The valve stem is connected to the lever so as to be operable in response to the breathing demand of the user for controlling the main flow of air from the air supply valve. The air inlet valve stem also receives and transmits a second flow of air from the air supply valve irrespective of the position of the valve stem.

The adjusting apparatus of the present invention includes air inlet valve stem retaining means positioned within the regulator device and adjustable axially for retaining a portion of the adjustable spring biasing means, for retaining a portion of the valve stem movably therewithin, and for forming a chamber with the portion of the valve stem retained therein for receiving the second flow of air from the valve stem. The air flow into the chamber, upon adjustment of the retaining means as hereafter described, pneumatically biases the valve stem toward the valve seat, thereby balancing the position of the valve stem between the retaining means and the valve seat and restraining the opening of the air inlet valve when the valve stem is not in contact with the valve seat. The retaining means is adjusted by employing non-metallic retainer adjusting means mounted within the regulator device but adjustable externally of the regulator device. The retainer adjusting means is operable for axially moving the air inlet valve retaining means toward and away from the air inlet valve seat, whereby the tension on the adjustable spring biasing means can be selectively increased or decreased by the user during use o the system. Preferably both the retaining means and the retainer adjusting means are non-metallic, most suitably of a substantially rigid plastic material. The retaining adjustment means is desirably comprised of a non-metallic shaft rotatably journaled in the air inlet valve housing and extending externally from said housing, and a non-metallic knob mounted on the shaft externally of the housing and rotatable only with the shaft. The shaft has threads engaging mating threads on the retainer means. In this manner, rotation of the knob causes the threads on said shaft to rotate and axially move the retaining means toward and away from the air inlet valve seat.

The adjusting apparatus of the present invention also includes air injector means mounted in the regulator device for supplying and direction a flow of air from the air inlet valve separate from the main flow of air from the air inlet valve. The air injector means is coupled to the air inlet supply valve and has rotatable adjusting means external to the regulator device for adjusting the air injector means within the regulator device. By movement of the adjusting means, the flow of air from the injector means can be adjustably directed between a first position toward the mouthpiece and away from the diaphragm, a second position toward the diaphragm and away from the mouthpiece, and a third position intermediate the first and second positions. By controlling the direction of the flow of air between these positions, the pressure of air flowing from the air inlet supply to the mouthpiece can be changed to adjust the pressure at the inlet valve side of the diaphragm, thereby selectively adjusting the position of the diaphragm to control the amount of breathing effort required of the user to keep the air inlet valve open.

Preferably the air injector means adjusting apparatus comprises a tube having an inlet pneumatically coupled to the air inlet supply valve housing to receive a flow of air therefrom and has an outlet intermediate its ends, with the tube being directionally adjustable between the three positions.

DETAILED DESCRIPTION

Figure 2:
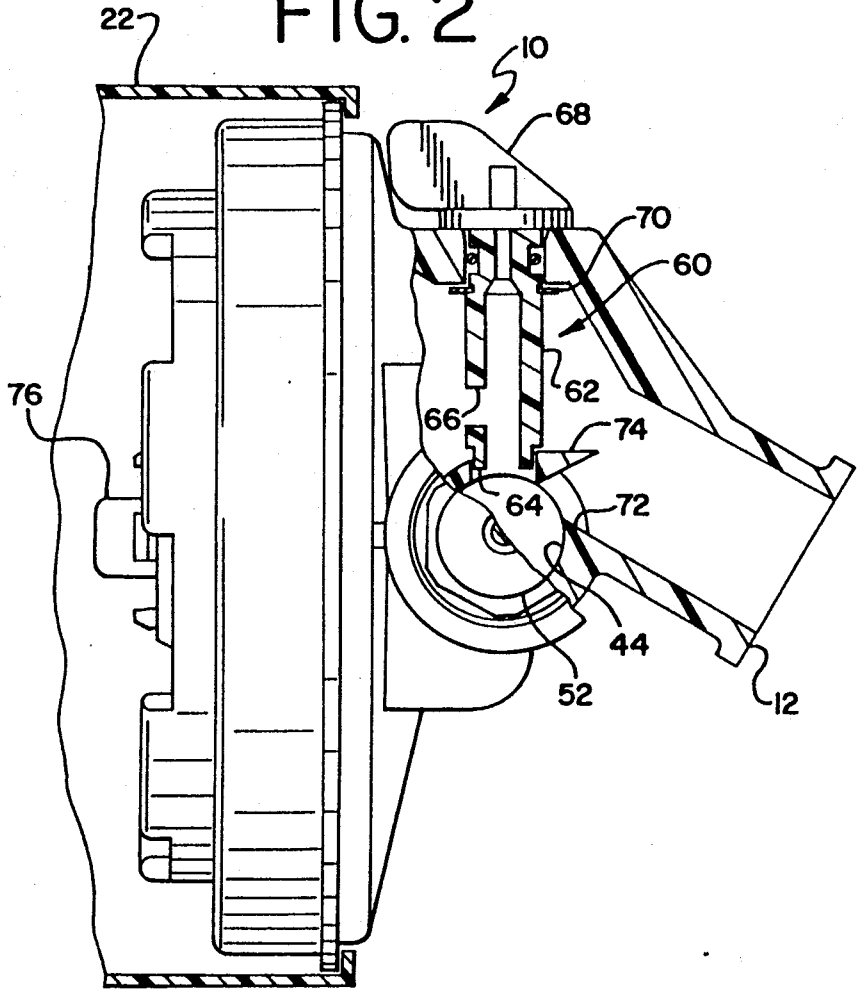
FIG. 2 is a view substantially similar to FIG. 1 showing the apparatus of the present invention adjusted into another position.
Figure 1:
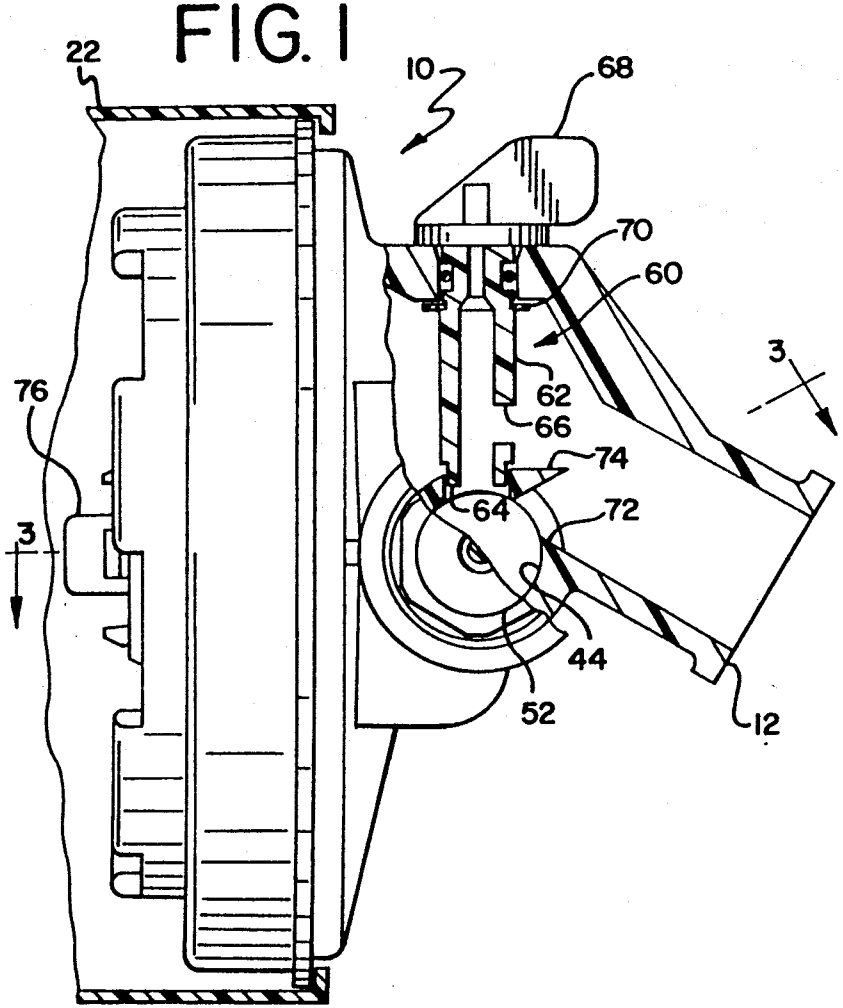
FIG. 1 is a side view, partially in cross-section, of a regulator incorporating the present invention.
Figure 3:
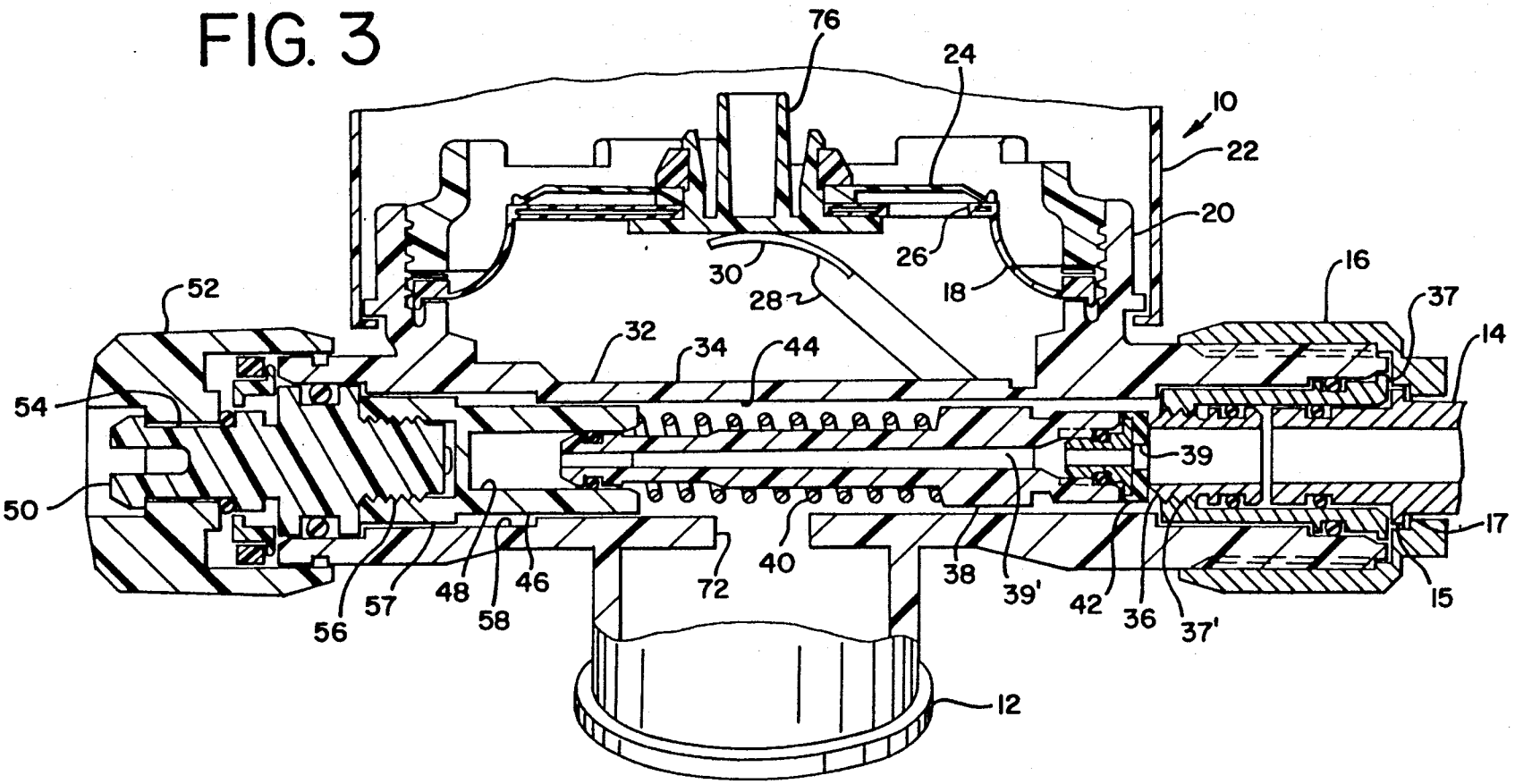
FIG. 3 is a sectional view of a regulator having the apparatus of the present invention and being taken along line 3—3 of FIG. 1 and in the direction indicated generally.

Referring now to the drawings, and in particular to FIGS. 1—3, there is shown a regulator 10 on which is mounted a mouthpiece tube 12, which may be integral with the regulator 10. A mouthpiece (not shown) is secured to mouthpiece tube 12 and sealed against fluid leakage as is known in the art. In a demand breathing system, regulator 10 is pneumatically coupled with a tank (not shown) of air or other breathable gaseous mixture (hereafter referred to as "air" for brevity) under pressure through a first valve (not shown) usually mounted on the tank. Air from the tank and first valve is conveyed to regulator 10 by means of a conduit 14, which can be a flexible tube or hose, having a swaging or flange 15 and secured to regulator 10 by a retaining cap 16 having a corresponding shoulder 17 (FIG. 3). The tank is usually supported on the back of the user, and regulator 10 positioned with the mouthpiece in the mouth of the user with the conduit 14 extending therebetween.

Regulator 10 includes a diaphragm 18 mounted therein and supported by a housing 20 to retain diaphragm 18 while permitting it to deflect in response to changes in air pressure on the air inlet side of diaphragm 18, i.e., the side facing mouthpiece tube 12. Diaphragm 18 and housing 20 are enclosed by a cover 22, with openings (not shown) to permit exhausted air to escape from regulator 10 and to permit fluid from the surroundings, e.g. water if the breathing system is used for diving, to enter so as to exert pressure on the opposite side of the diaphragm 18. Cover 22 is preferably flexible, in part for a purpose to be hereafter described. Diaphragm 18 can also include an exhaust valve or portion 24 which can be deflected by air pressure on the air inlet side of diaphragm 18 after diaphragm 18 has been deflected away from mouthpiece tube 12 to the fullest extent. Diaphragm 18 can include a port 26 to permit the air on the inlet side of diaphragm 18 to pass therethrough to exert pressure on portion 24.

Regulator 10 further includes a lever 28 which has one end position 30 normally abutting a portion of diaphragm 18 so that lever 28 moves in response to the movement of diaphragm 18. The function of lever 28 hereinafter will be described in greater detail.

Regulator 10 includes air inlet valve 32 which desirably is aligned and coupled with conduit 14 within valve housing 34. The end of housing 34 adjacent conduit 14 supports a valve seat 36 against which valve stem 38 is normally held by means of a biasing spring 40, and is movable within housing 34 away from seat 36 against the force of spring 40. Valve seat 36 and a valve seat retainer 37 are formed of metal so that the parts receiving relatively high pressure air from conduit 14 will withstand that pressure without deforming as might occur if those components were of plastic. In this manner, housing 34, being of rigid plastic, is not subjected to the relatively high pressure air from conduit 14. Valve stem 38 is connected to lever 28 so that deflection of diaphragm 18 toward mouthpiece 12 will cause lever 28 to deflect and move valve stem 38 away from seat 36, and subsequent deflection of diaphragm 18 in the opposite direction will allow lever 28 to return to its normal position, allowing valve stem 38 to return to its normal position against seat 36. Valve seat 36 is secured to retainer 37 by relatively fine screw threads 37', whereby advancing or retracting seat 36 with respect to retainer 37 will initially position or set the lever 28 and the point within housing 20 at which lever 28 engages diaphragm 18. In addition, by removing cap 16, conduit 14, and retainer 37, valve seat 36 can be replaced by unscrewing the latter from retainer 37.

When valve stem 38 is moved away from seat 36, air from conduit 14 passes between seat 36 and the end portion 42 of stem 38 into the cavity 44 formed by housing 34. End portion 42 is preferably made of non-metallic material to cushion the closing or seating of stem 38 against seat 36, and includes a central bore 39 through which a portion of the stream of air from conduit 14 may pass. The remainder of stem 38 also includes a central bore 39' through which the stream of air flowing through the bore 39 in end portion 42 may pass. The opposite end portion of stem 38 is retained in a retainer 46, for axial movement within retainer 46. Retainer 46 also retains and exerts pressure on biasing spring 40, and forms a camber 48 which receives the stream of air flowing through the bore 39' of stem 38 for a purpose to be thereafter described.

The adjusting apparatus of the present invention includes an adjusting mechanism for axially moving retainer 46 toward and away from seat 36 to provide for adjustment of the tension of biasing spring 40 by the suer during use of the breathing system. As shown, the adjusting mechanism includes a non-metallic shaft 50 rotatably supported within housing 34 and extending therefrom, and a non-metallic knob 52 mounted to the portion of shaft 50 extending externally from housing 34 and secured to shaft 50 for rotation therewith by means of splines 54 on shaft 50 engaging mating splines on knob 52. The opposite end portion of shaft 50 is threaded and mates with internal threads 56 formed on the end portion of retainer 46. Knob 52 is mounted so that it is not freeably rotatable nor extends from a thin shaft, and thereby cannot be readily accidently rotated or caught on structures which may otherwise occur.

Upon purposeful adjustment of knob 52 by the user, the shaft 50 rotates within the housing 34, but does not move axially. Instead, the retainer 46, through its threaded engagement with the shaft 50, moves axially within the cavity 44 to adjust tension on the spring 40. In the preferred embodiment, the retainer 46 is provided with splines 57 which are engaged in a track 58 formed in the housing 34. If rotation of knob 52 is attempted to advance retainer 46 toward valve seat 36 beyond the limits of threads 56, the threads will eventually disengage, and retainer 46 will not advance further, as spring 40 will hold retainer 46 against the end of shaft 50. Upon subsequent adjustment in the opposite direction, the threads will reengage due to the action on the retainer of spring 40. Overadjustment by the user which would fully retract retainer 46 away from spring 40 and stem 38 is prevented, since full retraction of the retainer 46 would open the valve 32 permitting the free flow of air from conduit 14 to mouthpiece 12 and thus alerting the user to this condition. Thus, by rotation of the knob 52, the tension on biasing spring 40 can be selectively increased or decreased, thereby adjusting the balancing of valve stem 38 between retainer 46 and set 36, and though the adjustment of the tension on biasing spring 40 restraining the opening of air inlet valve 32 when stem 38 is not in contact with seat 36. The adjusting mechanism provides for limiting the adjustment, while preventing its being damaged by attempted overadjustment.

The adjusting apparatus of the present invention further includes an adjustable air injector device, which as best shown in FIGS. 1 and 2, is generally designated by numeral 60. Air injector device 60 is shown as including an air injector tube 62 with its open end or inlet 64 pneumatically coupled with cavity 44 of air inlet valve housing 34. It should be noted that the inlet 64 is pneumatically coupled to the cavity 44 separately from the main flow of air. Tube 62 has an outlet 66 intermediate its ends, and is closed at its upper end opposite inlet 64. The outlet 66 is preferably a small circular opening of approximately 1/8 inch diameter to increase the flow velocity therethrough relative to the velocity of air directed at the mouthpiece tube 12 from the cavity 44. Tube 62 is integral with a knob 68 external to regulator 10 so as to be adjustably rotatable with the knob, and the tube and knob are retained by a clip or snap ring 70.

FIG. 1 shows air injector tube 62 in a first position with outlet 66 directed toward mouthpiece tube 12 and away from diaphragm 18. FIG. 2 shows air injector tube 62 in a second position with outlet 66 directed toward diaphragm 18 and away from mouthpiece tube 12. It is contemplated that knob 68 may be adjusted to a third position intermediate the first and second positions, wherein air injector tube 62 is positioned with outlet 66 directed toward the side, i.e. directed toward neither diaphragm 18 nor mouthpiece tube 12. It should be noted here that although three basic positions have been described for the injector tube 62, the tube is infinitely adjustable between the positions shown in FIGS. 1 and 2.

Additionally, air inlet valve housing 34 includes an outlet port 72 leading and directed to mouthpiece tube 12 through which the main stream of air from air inlet valve cavity 44 flows directed toward mouthpiece tube 12. The port 72 is preferably constructed as an elongate rectangle, and upper edge of port 72 is defined by a wedge shaped member 74 which directs the main stream of air from cavity 44 toward mouthpiece tube 12. The narrow port 72 as compared to the volume of cavity 44 tends to create a venturi effect upon the main stream of air as it flows through port 72 and into mouthpiece tube 12, assisting the inhalation of the stream of air by the user.

In operation, the air inlet valve 32 is initially closed by the bias of spring 40 and assisted by the portion of air flow from conduit 14 passing through the central bore of stem 38, entering chamber 48 and impinging upon the end of stem 38 opposite seat 36. Upon inhalation by the user, air is withdrawn from the cavity formed within regulator 10 between diaphragm 18 and mouthpiece tube 12, causing diaphragm 18 to deflect toward mouthpiece tube 12, and forcing lever 28 to deflect, moving valve stem 38 away from seat 36. The main stream of air from conduit 14 flows between seat 36 and stem 38, through cavity 44 and outlet 72 into mouthpiece tube 12 and through the mouthpiece to the user.

The effort or the amount of demand of the inhalation of the user needed to open or crack the valve 32 can be adjusted by the user by adjusting knob 52, causing the retainer 46 to increase or decrease the tension on spring 40. An increase in the tension of spring 40 causes a greater inhalation demand on the user to open valve 32, while a decrease in the tension on spring 40 will cause the opposite result. Advantageously, the splined shaft 50 and knob 52 arrangement and positive threaded connection between shaft 50 and retainer 46 prevents accidental adjustment from being made without purposeful adjustment of knob 52, and the valve stem 38 is cushioned against casual or accidental misadjustments. Additionally, having the knob 52, shaft 50 and retainer 46 of non-metallic material reduces unintended changes to the latter which may result if those components were metallic, due in large part to changes in temperature, for example when the system is used for diving into cold water or water having lowered temperatures t the greatest depth of the dive.

The presence of the adjustable air injector device 60, in the preferred embodiment including injector tube 62 and the knob 68, permits adjustment by the user to assist or resist the effort or demand required to effect operation of the regulator. When the tube 62 is in the first position with outlet 66 directed toward mouthpiece tube 12, the stream of air passing through inlet 64 and out the outlet 66 is added at relatively higher velocity to the main stream of air passing through port 72, thus injecting the air into the user's mouth. In addition, the action of the tube 62 creates a suction on the air inlet side of diaphragm 18 and a consequent early deflection of the diaphragm and relatively effortless opening of air inlet valve 32 upon inhalation.

With the tube 62 in the second position, the stream of air from inlet 64 is directed to diaphragm 18, increasing the pressure on the air inlet side of the diaphragm, or counteracting the suction due to inhalation, and thereby requiring a greater inhalation effort or demand by the user to open air inlet valve 32. The most desirable position of the injector tube 62 for most users, is the third position, in which the air stream is directed toward neither mouthpiece tube 12 nor diaphragm 18, and a normal demand or inhalation effort is required to open air inlet valve 32. As a user encounters increased ambient pressure, for example, when a relatively high current is encountered, adjustment of the injector tube can be made by turning knob 68 to rotate the injector tube 62 with outlet 66 increasingly directed toward the diaphragm 18 to increase the pressure in the regulator to offset the increased ambient pressure on the opposite or outwardly facing side of the diaphragm. However, where greater air pressure to the mouthpiece 12 is desired, as when a diver descends to a greater depth, the knob can be rotated in the opposite direction to approach or reach the position illustrated in FIG. 1. As only a constant portion of the air from cavity 44 is tapped by the air injector tube 62, gradual changes in user breathing effort can be effected, unlike the attempts at improvement disclosed in the prior art.

Occasionally, the user may find it necessary to clear the regulator of water and/or obtain a quantity of air rapidly, as when the user has not used the breathing system for some period during a dive. To fulfill such requirements, a purge mechanism is included in regulator 10. In particular, a purge button 76 is provided supported by diaphragm 18, which button may also be used as the abutting surface in diaphragm 18 to abut portion 30 of lever 28. Cover 22 is made flexible, in part to permit the user to easily depress cover 22 above purge buttock 76 to depress the button. When purge button 76 is depressed, lever 28 is directly deflected, opening air inlet valve 32 and causing a surge of air from conduit 14 to enter cavity 44 and exit through port 72 to mouthpiece tube 12 and hence to the user. At the same time, the depression of diaphragm 18 by depressing purge button 76 decreases the volume of the space between diaphragm and mouthpiece tube 12, forcing air and water within the space to be exhausted through port 26 and the edge of portion 24 of the diaphragm as portion 24 is deflected from its seat by the fluid pressure within the described space.

Figure 4:
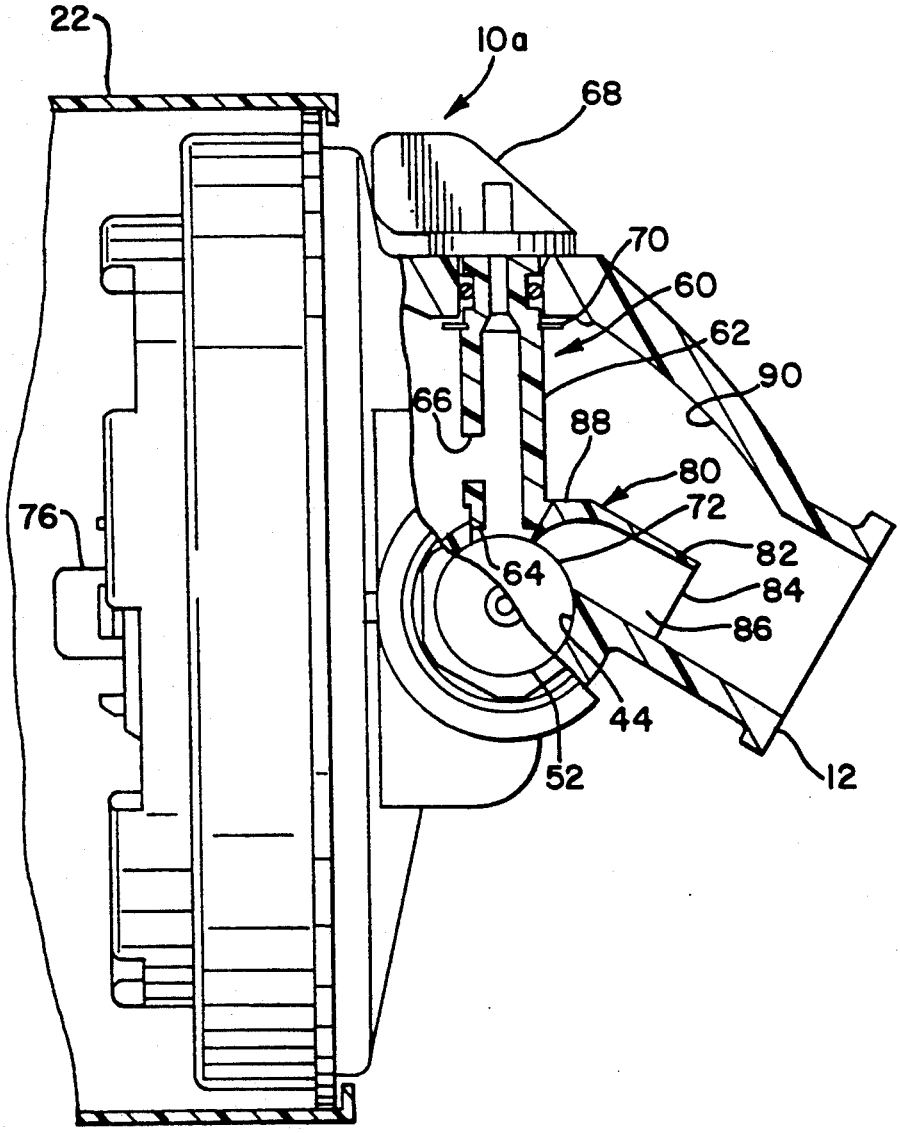
FIG. 4 is a side view, partially in cross-section, of an alternate embodiment of the regulator sown in FIG. 2.

Referring now to FIG. 4 an alternate embodiment of the regulator 10 is indicated generally at **10*a*. The regulator 10*a* is substantially identical to the regulator 10, and identical components are indicated with the same reference numeral. The main structural difference between the regulators 10 and 10*a* is the regulator 10*a*, the wedge shaped member 74 has been replaced by a chute formation, generally designated 80**.

Chute formation 80 covers the port 72 and includes a top 82, and a pair of sides 84, which combine to define an opening 86. The chute formation 80 is dimensioned to extend from the port 72 toward the open end of the mouthpiece tube 12, and has been found to direct air at greater velocities into the diver's mouth. This feature enhances the Venturi effect of the port 72, particularly when the regulator **10*a* is placed under greater loads, such as at greater depths. If desired, a portion of the top 82 may be beveled as shown at 88 to ensure an unobstructed path for air emitted from the outlet 66**.

Another distinctive feature of the regulator **10*a* is that an inner wall 90 of the mouthpiece tube 12 is generally dome-shaped configuration. This shape has been found to provide a relatively smooth transition of air traveling from the cavity 44 (best seen in FIG. 3) to the mouthpiece tube 12**.

While a particular embodiment of the breathing regulator having air injector feature of the invention has been shown and described, it will be appreciated by those skilled in the art that changes and modifications may be made thereto without departing from the invention in its broader aspects and as set forth in the following claims.

We claim:

1. Demand pressure adjusting apparatus for a user demand breathing system including an air supply, an air supply valve controlling the amount of air supplied from the air supply to the system, a mouthpiece and a regulator device pneumatically coupled between the air supply valve and the mouthpiece, the regulator device having a diaphragm mounted within the regulator device so as to be movable in response to the breathing demand of a user breathing through the mouthpiece, a lever having a portion normally abutting a portion of the diaphragm for controlling the movement of the lever responsive to the movement of the diaphragm, and an air inlet valve having a housing, a valve seat within the housing, a valve stem movable within the housing with respect to the valve seat and connected to the lever and thereby being operable in response to the breathing demand of the user for controlling the main flow of air from the air supply valve, the air inlet valve stem having means for receiving and transmitting a second flow of air from the air supply valve irrespective of the position of the valve stem, and adjustable spring biasing means for biasing the valve stem against the valve seat, said adjusting apparatus comprising:

a. air inlet valve stem retaining means positioned with the regulator device and adjustable axially for retaining a portion of the adjustable spring biasing means, for retaining a portion of the valve stem movably therewithin, and for forming a chamber with the portion of the valve stem retained therein for receiving the second flow of air from the valve stem for pneumatically biasing the valve stem toward the valve seat, thereby balancing the position of the valve stem between the retaining means and the valve seat and restraining the opening of the air inlet valve when the valve stem is not in contact with the valve seat, b. retainer adjusting means mounted within the regulator device and being adjustable externally to the regulator device for axially moving said air inlet valve retaining means toward and away from the air inlet valve seat, whereby the tension on the adjustable spring biasing means can be selectively increased or decreased by the user during the use of the system, and c. air injector means having ends and mounted in the regulator device, coupled to the air inlet supply valve and having rotatable adjusting means external to the regulator device for adjusting said air injector means within the regulator device for supplying and directing a flow of air from the air inlet valve separate from the main flow of air from the air inlet valve, adjustably directed between a first position toward the mouthpiece and away from the diaphragm, and a second position toward the diaphragm and away from the mouthpiece for adjusting the pressure of air flowing from the air inlet supply to the mouthpiece to adjust the pressure at the inlet valve side of the diaphragm, thereby selectively adjusting the position of the diaphragm to control the amount of breathing effort required of the user to open the air inlet valve, said air injector means having an inlet pneumatically coupled to the air inlet supply valve housing to receive a flow of air therefrom and having an outlet intermediate said ends, and said air injector means being directionally adjustable between said positions.

2. The adjusting apparatus defined in claim 1, wherein said air injector means includes a tube.

3. The adjusting apparatus defined in claim 1, wherein said outlet of said air injector means is dimensioned to inject air at a high velocity relative to the main flow.

4. The adjusting apparatus defined in claim 2, wherein the rotatable adjusting means comprises a knob selectively rotatably mounted on the regulator device and connected with said tube so as to be rotatable therewith.

5. The adjusting apparatus defined in claim 1, wherein the retainer adjusting means comprises a non-metallic shaft rotatably journaled in the air inlet valve housing and extending externally from said housing, aid shaft having threads engaging mating threads on said retainer means, and a non-metallic knob mounted on said shaft externally of said housing and rotatable only with said shaft, whereby rotation of said knob causes the threads on said shaft to rotate and axially move the retaining means toward and away from the air inlet valve seat.

6. The adjusting apparatus defined in claim 1, wherein the retainer adjusting means comprises a shaft having screw threads, and said retaining means having screw threads mating with the screw threads of said shaft, said shaft being rotatable with respect to said retaining means, whereby adjustment of the retainer adjusting means toward the valve seat causes unthreading of said retainer means with respect to said shaft, and upon disengagement of said threads of said shaft from said threads of said retaining means, no further adjustment of the retaining means toward said valve seat can be made, and the retaining means is held against the end of said shaft by the spring biasing means.

7. The adjusting apparatus as defined in claim 1 further including means for directing the main flow of air into the mouthpiece.

8. The adjusting apparatus as defined in claim 7 wherein said means for directing includes a chute formation in fluid communication with the air inlet valve housing and configured for directing the main flow of air into the regulator toward the mouthpiece.

9. Adjusting apparatus for a user demand breathing system including an air supply, an air supply valve controlling the amount of air supplied from the air supply to the system, a mouthpiece and a regulator device pneumatically coupled between the air supply valve and the mouthpiece, the regulator device having a diaphragm mounted within the regulator device so as to be movable in response to the breathing demand of a user breathing through the mouthpiece, a lever having a portion normally abutting a portion of the diaphragm for controlling the movement of the lever responsive to the movement of the diaphragm, and an air inlet valve having a housing, a valve seat within the housing, a valve stem movable within the housing with respect to the valve seat and connected to the lever and thereby being operable in response to the breathing demand of the user for controlling the main flow of air from the air supply valve, the air inlet valve having means for receiving and transmitting a second flow of air from the air supply valve irrespective of the position of the valve stem, and adjustable spring biasing means for biasing the valve stem against the valve seat, said adjusting apparatus comprising:

a. air inlet valve stem retaining means positioned within the regulator device and adjustable axially for retaining a portion of the adjustable spring biasing means, for retaining a portion of the valve stem movably therewithin, and for forming a chamber with the portion of the valve stem retained therein for receiving the second flow of air from the valve stem for pneumatically biasing the valve stem toward the valve seat, thereby balancing the position of the valve stem between the retaining means and the valve seat and restraining the opening of the air inlet valve when the valve stem is not in contact with the valve seat, and b. retainer adjusting means mounted within the regulator device and being adjustable externally to the regulator device for axially moving said air inlet valve retaining means toward and away from the air inlet valve seat, said retainer adjusting means including a shaft rotatably journaled in the air inlet valve housing and extending externally from said housing, said shaft having threads engaging mating threads on said retainer means, and a knob mounted on said shaft externally of said housing and rotatable only with said shaft, whereby rotation of said knob causes the threads on said shaft to rotate and axially move the retaining means toward and away from the air inlet valve seat, and whereby the tension on the adjustable spring biasing means can be selectively increased or decreased by the user during use of the system.

10. The adjusting apparatus defined in claim 9, wherein the retainer adjusting means comprises a shaft having screw threads, and said retaining means having screw threads mating with the screw threads of said shaft, said shaft being rotatable with screw threads mating with the screw threads of said shaft, said shaft being rotatable with respect to said retaining means, whereby adjustment of the retainer adjusting means toward the valve seat causes unthreading of said retainer means with respect to said shaft, and upon disengagement of said threads of said shaft from said threads of said retaining means, no further adjustment of the retaining means toward said valve seat can be made, and the retaining means is held against the end of said shaft by the spring biasing means.

11. Adjusting apparatus for a user demand breathing system including an air supply, an air supply valve controlling the amount of air supplied from the air supply to the system, a mouthpiece and a regulator device pneumatically coupled between the air supply valve and the mouthpiece, the regulator device having a diaphragm mounted within the regulator device so as to be movable in response to the breathing demand of a user breathing through the mouthpiece, a lever having a portion normally abutting a portion of the diaphragm for controlling the movement of the lever responsive to the movement of the diaphragm, and an air inlet valve having a housing, a valve seat within the housing, a valve stem movable within the housing with respect to the valve seat and connected to the lever and thereby being operable in response to the breathing demand of the user for controlling the main flow of air from the air supply valve, said adjusting apparatus comprising:

air injector means having ends and mounted in the regulator device, coupled to the air inlet supply valve and having rotatable adjusting means external to the regulator device for adjusting said air injector means within the regulator device for supplying and directing a flow of air from the air inlet valve separated from the main flow of air from the air inlet valve, adjustably directed between a first position toward the mouthpiece and away from the diaphragm, and a second position toward the diaphragm and away from the mouthpiece for adjusting the direction of a portion of air flowing from the air inlet supply thereby adjusting the pressure at the inlet valve side of the diaphragm, thereby selectively adjusting the position of the diaphragm to control the amount of breathing effort required of the user to open the air inlet valve, said air injector means including an inlet pneumatically coupled to the air inlet supply valve housing to receive a flow of air therefrom and having an outlet intermediate said ends, and said air injector means being directionally adjustable between said positions.

12. The adjusting apparatus defined in claim 11, wherein the air injector means includes tube.

13. The adjusting apparatus defined in claim 11, wherein said outlet of said tube is dimensioned to inject air at a high velocity relative to the main flow.

14. An air injector device for a second stage regulator for a user demand breathing system, the regulator including a diaphragm, a mouthpiece tube and an air inlet supply valve, said air injector device comprising:

a. air injector means having ends and mounted in the regulator and pneumatically coupled to the air inlet supply valve for supplying and directing a flow of air from the air inlet valve separate from the main flow of air from the air inlet valve, said air injector means having an inlet pneumatically coupled to the air inlet supply valve to receive a flow of air therefrom and having an outlet intermediate said ends, and said injector means being directionally adjustable between said positions, b. rotatable adjusting means external to the regulator device connected to said air injector means for adjusting said air injector means within the regulator between a first position whereby the flow of air therefrom is directed toward the mouthpiece and away from the diaphragm, and a second position whereby the flow of air therefrom is directed toward the diaphragm and away from the mouthpiece, thereby adjusting the pressure of air flowing from the air inlet valve to the mouthpiece to adjust the pressure at the inlet valve side of the diaphragm, thereby selectively controlling the amount of breathing effort required of the user to open the air inlet valve.

15. The adjusting apparatus defined in claim 14, wherein said air injector means includes a tube.

16. The adjusting apparatus defined in claim 15, wherein said tube has an outlet dimensioned to inject air at a high velocity relative to the main flow.

17. The adjusting apparatus defined in claim 14, wherein the rotatable adjusting means comprises a knob selectively rotatably mounted on the regulator and connected with said air injector means so as to be rotatable therewith.

18. The adjusting apparatus as defined in claim 14 wherein the regulator has a port through which air enters from the air supply valve, and the regulator further includes a chute formation for directing the flow of air from the air inlet valve through the mouthpiece tube.

* * * * *